US007156619B2

(12) United States Patent
Papple

(10) Patent No.: US 7,156,619 B2
(45) Date of Patent: Jan. 2, 2007

(54) INTERNALLY COOLED GAS TURBINE AIRFOIL AND METHOD

(75) Inventor: Michael Leslie Clyde Papple, Ile des Soeurs (CA)

(73) Assignee: Pratt & Whitney Canada Corp., Longueuil (CA)

( * ) Notice: Subject to any disclaimer, the term of this patent is extended or adjusted under 35 U.S.C. 154(b) by 87 days.

(21) Appl. No.: 11/016,832

(22) Filed: Dec. 21, 2004

(65) Prior Publication Data

US 2006/0133935 A1 Jun. 22, 2006

(51) Int. Cl.
*B63H 1/14* (2006.01)

(52) U.S. Cl. ..... 416/96 R; 415/115; 415/116

(58) Field of Classification Search ..... 416/96 R, 416/96 A, 97 R, 97 A; 415/115, 116
See application file for complete search history.

(56) References Cited

U.S. PATENT DOCUMENTS 4,474,532 A 10/1984 Pazder et al.
4,775,296 A 10/1988 Schwarzmann et al.
5,073,083 A * 12/1991 Guyon ..... 415/115
5,232,343 A 8/1993 Butts
5,356,265 A 10/1994 Kercher
5,472,316 A 12/1995 Taslim et al.
5,538,394 A 7/1996 Inomata et al.
5,577,884 A 11/1996 Mari
5,624,231 A * 4/1997 Ohtomo et al. ..... 416/97 R
5,695,320 A 12/1997 Kercher
5,700,132 A 12/1997 Lampes et al.
5,720,431 A 2/1998 Sellers et al.
5,975,851 A 11/1999 Liang
6,132,169 A 10/2000 Manning et al.
6,139,269 A 10/2000 Liang
6,174,134 B1 1/2001 Lee et al.
6,234,754 B1 5/2001 Zelesky et al.
6,273,682 B1 8/2001 Lee
6,331,098 B1 12/2001 Lee
6,428,273 B1 8/2002 Keith et al.
6,602,047 B1 8/2003 Barreto et al.
6,607,355 B1 8/2003 Cunha et al.
6,607,356 B1 8/2003 Manning et al.
2003/0133795 A1 7/2003 Manning et al.
2004/0076519 A1 4/2004 Halfmann et al.

* cited by examiner

*Primary Examiner*—Hoang Nguyen
(74) *Attorney, Agent, or Firm*—Ogilvy Renault LLP

(57) ABSTRACT

An internally cooled airfoil for a gas turbine engine, wherein a plurality of elongated cooling fins are provided inside the concave sidewall between two crossovers.

21 Claims, 5 Drawing Sheets

INTERNALLY COOLED GAS TURBINE AIRFOIL AND METHOD

TECHNICAL FIELD

The field of the invention generally relates to internally cooled airfoils within gas turbine engines.

BACKGROUND OF THE ART

While many features have been provided in the past to maximize the heat transfer between cooling air and the airfoil, the design of gas turbine airfoils is nevertheless the subject of continuous improvements so as to further increase cooling efficiency without significantly increasing pressure losses inside the airfoil. An example of such area is the concave or pressure side of an airfoil, near the trailing edge. For instance, U.S. Pat. Nos. 6,174,134 and 6,607,356 disclose various structures intended to introduce turbulence in this region to enhance cooling efficiency, albeit at the price of an added pressure drop. Despite these past efforts, there is still a need to improve the cooling efficiency in some areas of airfoils.

SUMMARY OF THE INVENTION

In one aspect, the present invention provides an internally cooled airfoil for a gas turbine engine, the airfoil having at least one internal cooling passageway generally positioned between opposite concave and convex sidewalls, and a trailing edge outlet, the airfoil comprising: two spaced-apart crossovers located in the passageway and being adjacent to the trailing edge outlet, each crossover comprising a plurality of crossover holes, the crossovers being extending from the concave sidewall to the convex sidewall; and a plurality of elongated cooling fins provided inside the concave sidewall between the two crossovers.

In a second aspect, the present invention provides an airfoil for use in a gas turbine engine, the airfoil comprising a convex side, a concave side and a trailing edge at a rearmost portion of the airfoil, the airfoil having at least one internal cooling passageway with a first and a second crossover set across an airflow cooling path, the airfoil comprising a plurality of cooling fins located inside the cooling passageway and attached on the concave side between the two crossovers.

In a third aspect, the present invention provides a method of enhancing the cooling of an airfoil in a gas turbine engine, the airfoil comprising at least one internal cooling passageway generally situated between a concave sidewall and a convex sidewall, the method comprising: providing a first and a second crossover in the passageway, each crossover comprising a plurality of crossover holes; providing a plurality of elongated cooling fins inside the concave sidewall between the first and second crossovers; and circulating an airflow in the passageway, the air flowing through the crossover holes of the first crossover and then over the fins before flowing through the crossover holes of the second crossover.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
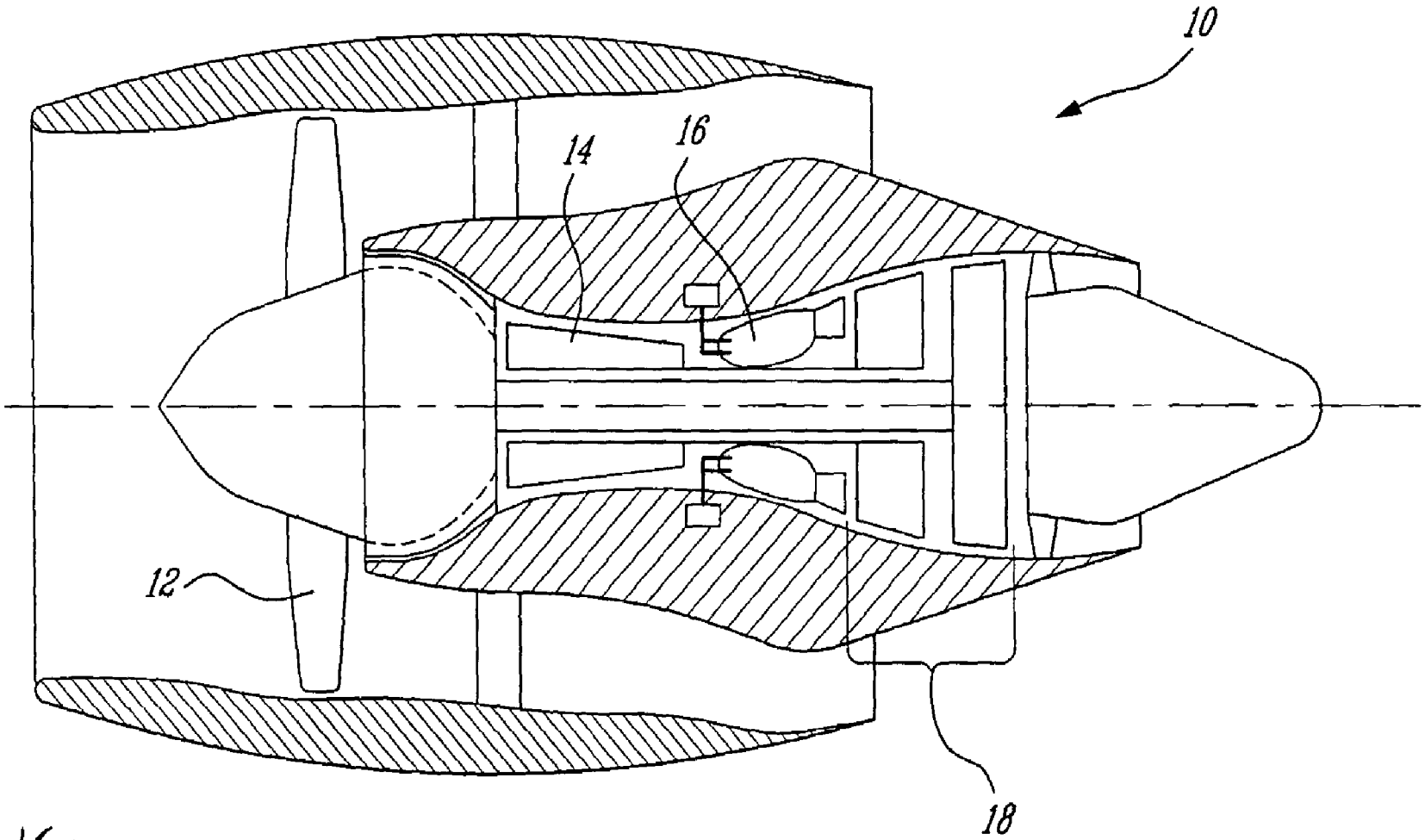
FIG. 1 schematically shows a generic gas turbine engine to illustrate an example of a general environment in which the invention can be used.

FIG. 1 illustrates an example of a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. This figure illustrates an example of the environment in which the present invention can be used.

Figure 2:
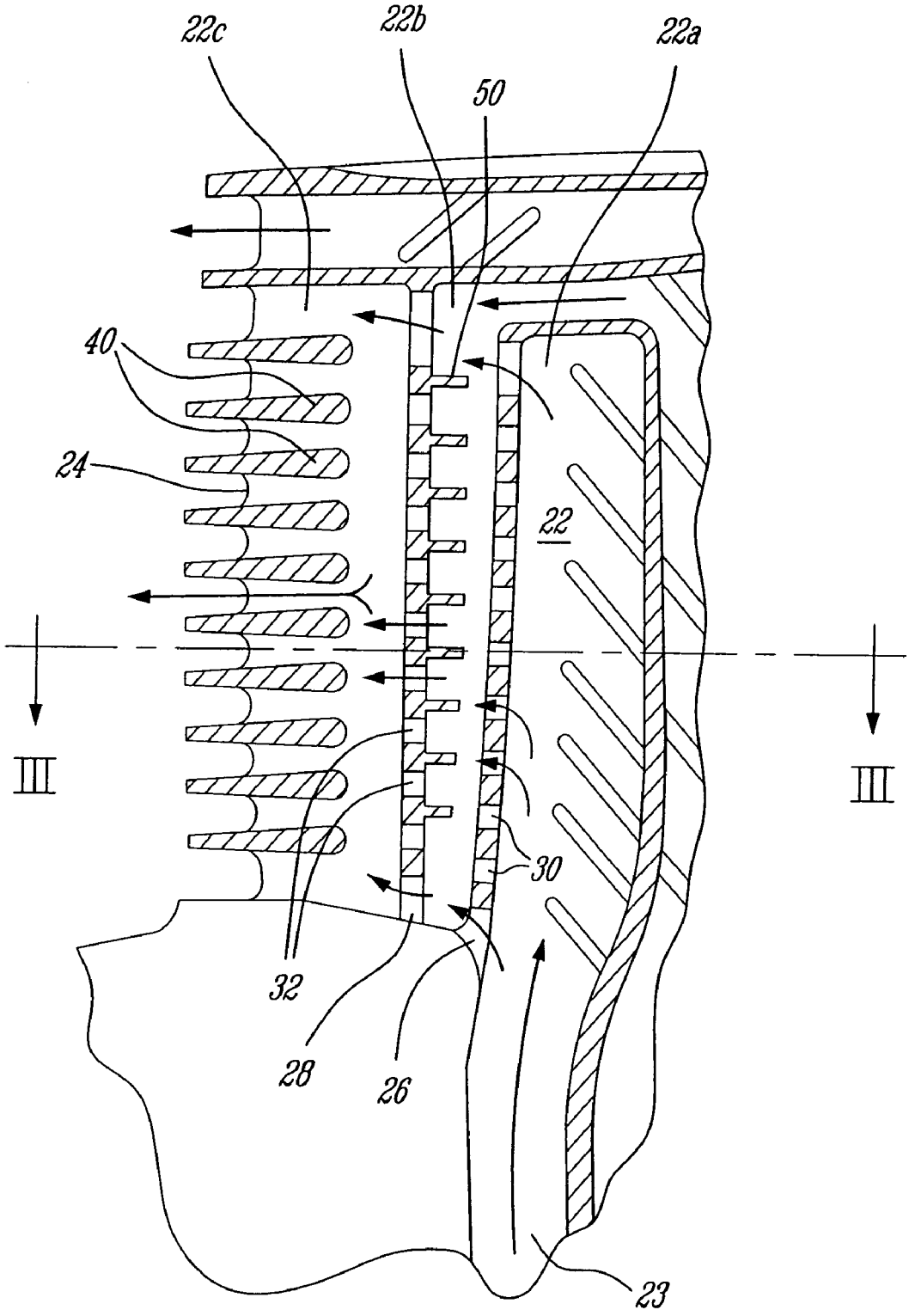
FIG. 2 is a partially cutaway view of an airfoil in accordance with one possible embodiment of the present invention.

FIG. 2 shows a cross section of the rear portion of an airfoil 20 in accordance with one possible embodiment of the present invention. This airfoil 20 comprises one or more internal cooling passageways, which will be hereafter generally referred to as the passageway 22. Air is supplied using one or more inlets 23 which generally communicate with openings (not shown) located under the airfoil 20. Some of the cooling air usually exits the airfoil 20 from the passageway 22 through a network of small holes provided at various locations in the airfoil's sidewalls. Some of the cooling air is also sent towards the outlet located at the trailing edge 24 of the airfoil 20.

Figure 3:
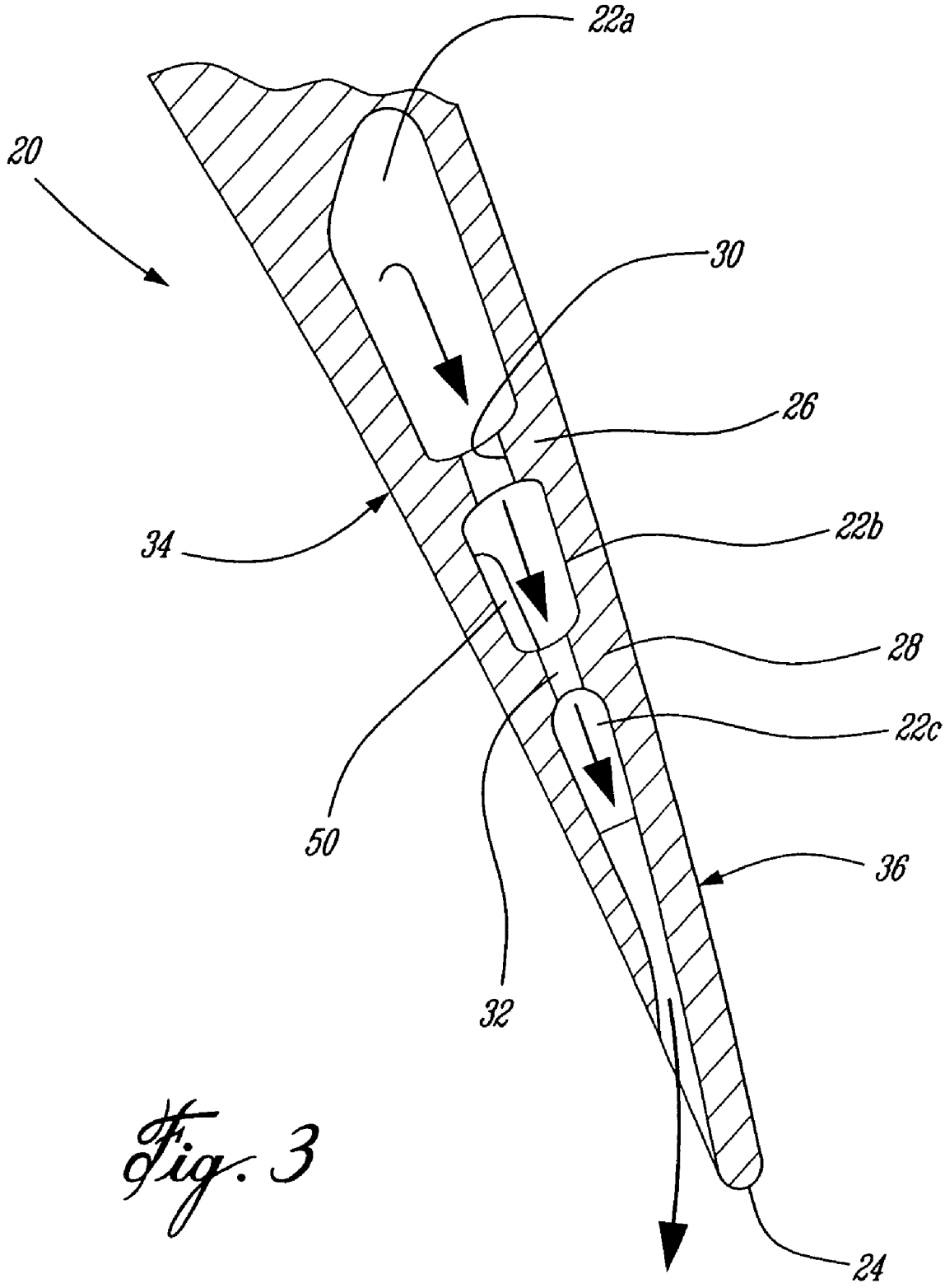
FIG. 3 is a cross-sectional view taken along line III—III in FIG. 2.

Passageway 22 has at least three legs 22*a*, 22*b*, and 22*c*, respectively, which are divided by at least two perforated lands or crossovers 26 and 28, respectively. Before cooling air passing through legs 22*a* and 22*b* may reach the leg 22*c* which communicates with the trailing edge 24, the cooling air must pass through one or more of the spaced-apart crossovers 26, 28 set across the airflow path. Each of these crossovers 26, 28 have a plurality of holes 30, 32. As best shown in FIG. 3, the crossovers 26, 28 extend from a concave sidewall 34 to a convex sidewall 36 of the airfoil 20. The crossovers 26, 28 are preferably configured and disposed so that at least some, and preferably all, of the holes 30 of the first crossover 26 are in a staggered or offset configuration relative to the holes 32 of the second crossover 28, as shown in FIG. 2. This way, air flowing through the holes 30 of the first crossover 26 impinges on a non-perforated portion of the second crossover 28, and must be slightly redirected before flowing out through the holes 32 thereof, which increases the heat transfer inside the airfoil 20. As also shown in the figures, typically lands 40 extend forwardly from the trailing edge 24.

The airfoil 20 comprises a plurality of elongated cooling fins 50 provided inside the concave sidewall 34 between the two crossovers 26, 28. These fins 50 are said to be elongated, having a length greater than a width. The fins 50 are aligned with the direction of flow therebetween, extend from crossover 28. Their purpose is to increase the surface area available for heat exchange without substantially increasing the pressure loss in the cooling air across the airfoil 20.

FIGS. 2 and 3 show that the fins 50 may extend from the crossover 28 to an intermediate location between the crossovers 26, 28. The fins 50 extend from the interior surface of the airfoil 20 and hence increase the surface area of the inner surface of the concave sidewall 34. At least some of the fins 50 are preferably generally parallel to each other, aligned with the direction of flow between the crossovers, and aligned and in registry with the holes 30 of crossover 26.

Figure 4:
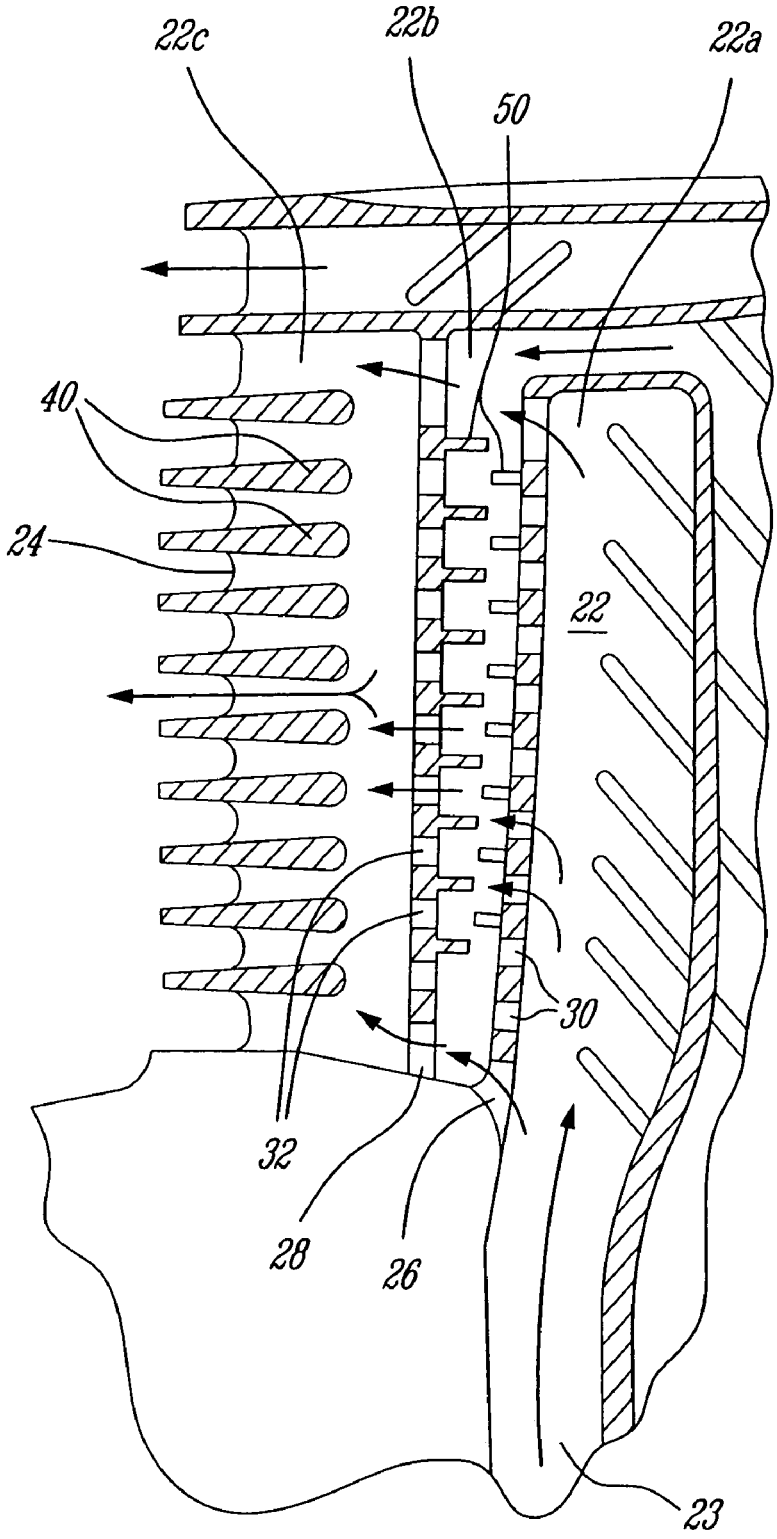
FIG. 4 is a view similar to FIG. 2, showing an airfoil in accordance with another possible embodiment of the present invention.

FIG. 4 shows an alternate embodiment in which two sets of fins 50 are provided, each extending from a portion of the crossover between holes 30 and 32, respectively. Air exiting holes 30 thus is directed by the fins 50 extending from crossover 26, to impinge and be slightly redirected by fins 50 extending from crossover 28. Each of these fins 50 preferably extends less than the distance between the two crossovers 26, 28.

Figure 5:
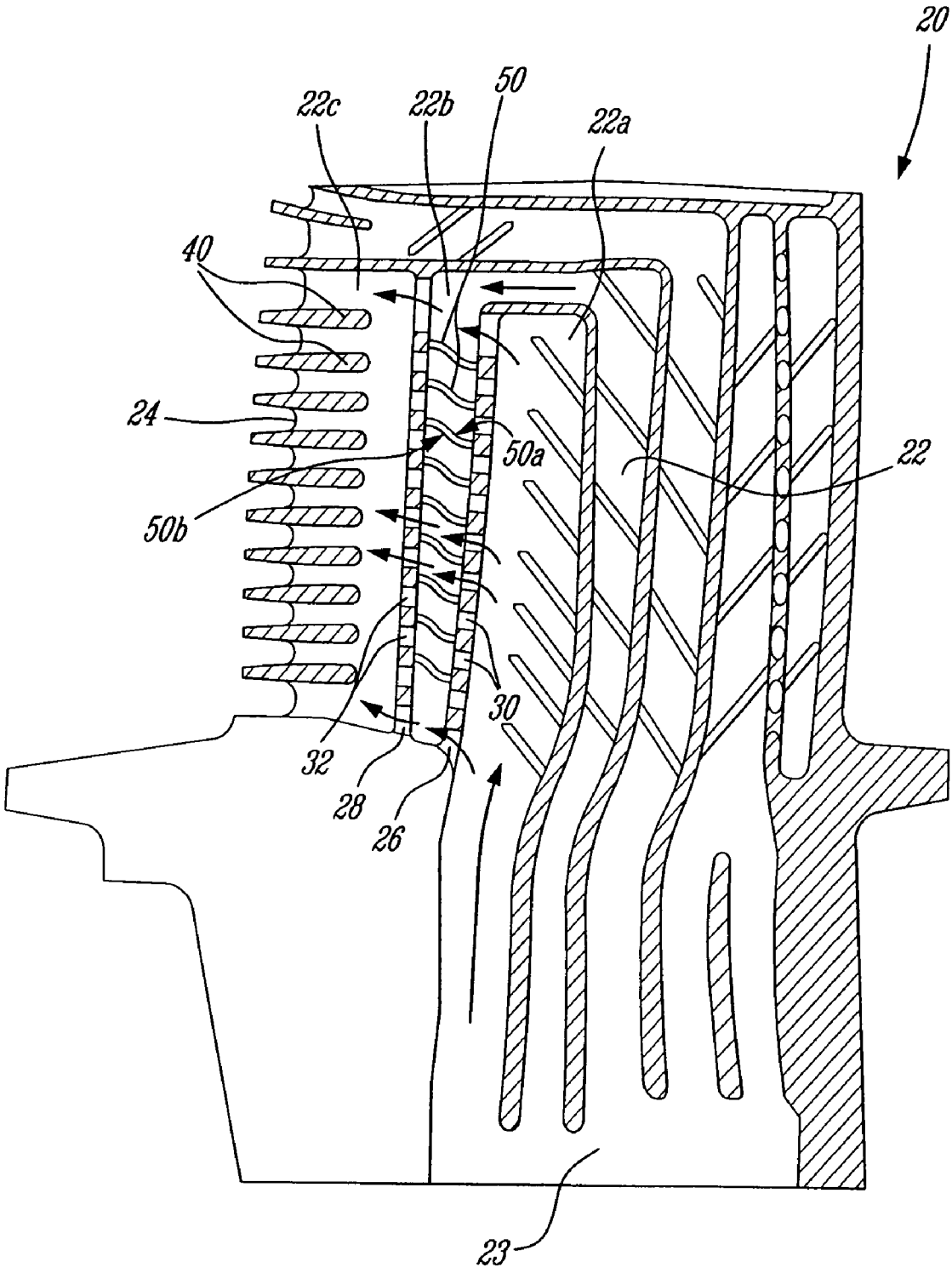
FIG. 5 is a cross-sectional view of an airfoil in accordance with another possible embodiment of the present invention.

FIG. 5 shows another embodiment in which the fins 50 extend the entire distance from the first crossover 26 to the crossover 28. They also have a curved shape which is generally aligned with the air flow path between crossovers 26 and 28. Air exiting holes 30 thus is directed by an upstream portion 50*a* of fins 50, to impinge and be slightly redirected by downstream portion 50*b* of fins 50 upstream of crossover 28.

In each embodiment, since impingement and redirection is slight, as compared to the prior art turbulators, pressure losses are less severe and yet heat transfer is acceptable. Unlike the prior art, the present invention offers cooling advantages without significantly increasing the pressure drop in the cooling airflow path. Consequently, lower pressure bleed air is required to drive the cooling system, which is less thermodynamically "expensive" to the overall gas turbine efficiency. The fins 50 thereby enhance the cooling of the airfoil 20 of a gas turbine engine 10. More heat is thus removed from that region of the concave sidewall 34. Hence, the concave sidewall 34 remains relatively cooler without the need of increasing the amount of air.

The above description is meant to be exemplary only, and one skilled in the art will recognize that changes may be made to the embodiments described without department from the scope of the invention disclosed. For example, all fins are not necessarily parallel to each other, or linearly configured, although alignment with the flow direction is preferred. Holes in the crossovers need not necessarily be staggered. The fins can be used in conjunction with other features or devices to increase heat transfer inside an airfoil. The use of the fins is not limited to the turbine airfoils illustrated in the figures, and the invention may also be employed with turbine vanes, and compressor vane and blades as well. Still other modifications which fall within the scope of the present invention will be apparent to those skilled in the art, in light of a review of this disclosure, and such modifications are intended to fall within the appended claims.

What is claimed is:

1. An internally cooled airfoil for a gas turbine engine, the airfoil having at least one internal cooling passageway generally positioned between opposite concave and convex sidewalls, and a trailing edge outlet, the airfoil comprising:

two spaced-apart crossovers located in the passageway and being adjacent to the trailing edge outlet, each crossover comprising a plurality of crossover holes, the crossovers being extending from the concave sidewall to the convex sidewall; and a plurality of elongated cooling fins provided inside the concave sidewall between the two crossovers.

2. The airfoil as defined in claim 1, wherein at least some of the fins are generally aligned with an airflow cooling path.

3. The airfoil as defined in claim 2, wherein at least some of the fins have at least one end in registry with a location on one of the crossovers between its crossover holes.

4. The airfoil as defined in claim 2, wherein with reference to the cooling air path, some of the fins form a first set of fins having a foremost end in registry with corresponding locations on a foremost of the two crossovers, between its crossover holes, and some of the fins form a second set of fins having a rearmost end in registry with corresponding locations on the other of the crossovers, between its crossover holes.

5. The airfoil as defined in claim 4, wherein the fins of the first set of fins and the fins of the second set of fins are positioned in a staggered configuration, the fins being shorted than a distance between the two crossovers.

6. The airfoil as defined in claim 1, wherein a majority of the crossover holes of one of the two crossovers are staggered with reference to the crossover holes of the other crossover, at least some of the fins having a curved shape.

7. The airfoil as defined in claim 6, wherein at least some of the fins extend from one of the crossovers to the other.

8. The airfoil as defined in claim 1, wherein at least some of the fins have an end in contact with one of the crossovers.

9. The airfoil as defined in claim 1, wherein some of the fins have one end in contact with one of the crossovers and the other fins have one end in contact with the other crossover.

10. The airfoil as defined in claim 1, wherein at least some of the fins have an end spaced apart from at least one of the crossovers.

11. An airfoil for use in a gas turbine engine, the airfoil comprising a convex side, a concave side and a trailing edge at a rearmost portion of the airfoil, the airfoil having at least one internal cooling passageway with a first and a second crossover set across an airflow cooling path, the airfoil comprising a plurality of cooling fins located inside the cooling passageway and attached on the concave side between the two crossovers.

12. The airfoil as defined in claim 11, wherein at least some of the fins are generally aligned with the cooling path.

13. The airfoil as defined in claim 12, wherein at least some of the fins have at least one end in registry with a location on one of the crossovers between crossover holes.

14. The airfoil as defined in claim 12, wherein with reference to the cooling air path, some of the fins form a first set of fins having a foremost end in registry with corresponding locations on a foremost of the two crossovers, between crossover holes thereof, and some of the fins form a second set of fins having a rearmost end in registry with corresponding locations on the other of the crossovers, between crossover holes thereof.

15. The airfoil as defined in claim 14, wherein the fins of the first set of fins and the fins of the second set of fins are positioned in a staggered configuration, the fins being shorted than a distance between the two crossovers.

16. The airfoil as defined in claim 11, wherein the crossovers comprise corresponding crossover holes, a majority of the crossover holes of one of the two crossovers are staggered with reference to the crossover holes of the other crossover, at least some of the fins having a curved shape.

17. The airfoil as defined in claim 16, wherein at least some of the fins extend from one of the crossovers to the other.

18. The airfoil as defined in claim 11, wherein at least some of the fins have an end in contact with one of the crossovers.

19. The airfoil as defined in claim 11, wherein some of the fins have one end in contact with one of the crossovers and the other fins have one end in contact with the other crossover.

20. The airfoil as defined in claim 11, wherein at least some of the fins have an end spaced apart from at least one of the crossovers.

21. A method of enhancing the cooling of an airfoil in a gas turbine engine, the airfoil comprising at least one internal cooling passageway generally situated between a concave sidewall and a convex sidewall, the method comprising:

providing a first and a second crossover in the passageway, each crossover comprising a plurality of crossover holes;

providing a plurality of elongated cooling fins inside the concave sidewall between the first and second crossovers; and circulating an airflow in the passageway, the air flowing through the crossover holes of the first crossover and then over the fins before flowing through the crossover holes of the second crossover.

* * * * *